US006860253B1

(12) United States Patent
Barnes et al.

(10) Patent No.: US 6,860,253 B1
(45) Date of Patent: Mar. 1, 2005

(54) COMPRESSION RELEASE ENGINE BRAKE CONTROL USING SPEED ERROR

(75) Inventors: Travis E. Barnes, Metamore, IL (US); Ronald D. Shinogle, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/640,491

(22) Filed: Aug. 13, 2003

(51) Int. Cl.[7] ..... F02D 13/04
(52) U.S. Cl. ..... 123/322
(58) Field of Search ..... 123/320, 321, 123/322

(56) References Cited

U.S. PATENT DOCUMENTS

| | | | | |
|---|---|---|---|---|
| 4,688,384 | A | 8/1987 | Pearman et al. | 60/600 |
| 4,787,044 | A | 11/1988 | Nagata et al. | 701/110 |
| 4,945,870 | A | 8/1990 | Richeson | 123/90.11 |
| 5,088,348 | A | 2/1992 | Hiramuki | 477/110 |
| 5,121,723 | A | 6/1992 | Stepper et al. | 123/322 |
| 5,123,397 | A | 6/1992 | Richeson | 123/568.14 |
| 5,190,013 | A | 3/1993 | Dozier | 123/481 |
| 5,193,657 | A | 3/1993 | Iizuka | 192/1.23 |
| 5,201,296 | A | 4/1993 | Wunning et al. | 123/479 |
| 5,393,276 | A | 2/1995 | White et al. | 477/91 |
| 5,540,201 | A | 7/1996 | Feucht et al. | 123/322 |
| 5,615,653 | A | 4/1997 | Faletti et al. | 123/322 |
| 5,718,199 | A | 2/1998 | Hu et al. | 123/322 |
| 5,733,219 | A | 3/1998 | Rettig et al. | 477/91 |
| RE36,007 | E | 12/1998 | White et al. | 477/91 |
| 5,967,115 | A | 10/1999 | Konopka et al. | 123/322 |
| 6,095,002 | A | 8/2000 | Tuson et al. | 74/335 |
| 6,470,851 | B1 | 10/2002 | DeGroot et al. | 123/323 |

*Primary Examiner*—Tony M. Argenbright
(74) *Attorney, Agent, or Firm*—Marshall, Gerstein & Borun LLP

(57) ABSTRACT

The minimum desired engine speed for engaging engine braking varies. The disclosed method includes determining a speed error by subtracting the desired engine speed from the actual engine speed, comparing the speed error to an error threshold, and generating a brake enable command if the speed error is greater than or equal to the error threshold.

14 Claims, 2 Drawing Sheets

COMPRESSION RELEASE ENGINE BRAKE CONTROL USING SPEED ERROR

TECHNICAL FIELD

This invention relates generally to compression release braking and, more particularly, to control of compression release braking systems.

BACKGROUND

Compression release engine braking is typically used in trucks, buses and other heavy machines. Compression release engine brake systems typically operate by opening a valve, such as an exhaust valve associated with an engine cylinder near the top dead center position of a corresponding piston during a compression stroke. Thus, the work performed by the engine to compress the air in the cylinder is dissipated before the piston moves away from the top dead center position.

Compression release engine braking is typically activated if certain engine and machine operational conditions are met. Such conditions may include clutch status, transmission status, engine speed, or whether the engine is in positive power mode (i.e., whether fuel is being supplied to the engine).

Most compression release engine braking systems and methods designate a predetermined minimum engine speed for braking, below which compression release engine braking will not be enabled. In such systems, compression release engine braking will disable when engine speed falls below the predetermined speed limit. For example, U.S. Pat. No. 5,967,115 discloses a compression release braking system that disables if the engine speed falls below a level that is fixed and predetermined for all engine operating conditions. In such systems, however, the minimum engine speed limit for braking is predetermined and cannot vary continuously based on the operational parameters of the machine. Accordingly, the minimum engine speed limit for braking may not represent the true minimum engine speed limit for braking under certain operational conditions. The present invention is directed to overcoming one or more of the problems or disadvantages associated with the prior art.

SUMMARY OF THE INVENTION

A method of enabling a compression release engine brake for a machine having an engine includes determining a speed error from an actual engine speed and a desired engine speed, and enabling the compression release engine brake if the speed error is greater than or equal to an error threshold.

DRAWINGS

DETAILED DESCRIPTION

Figure 1:
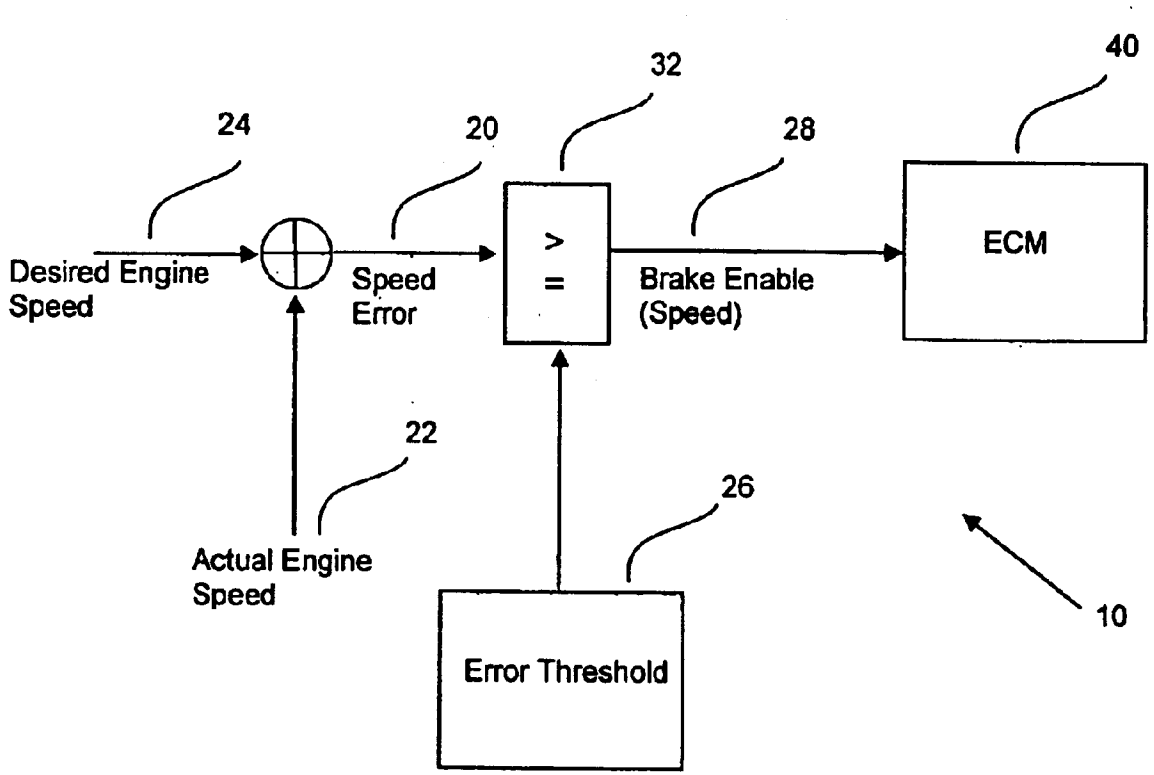
FIG. 1 is a diagram of a first example of a compression release brake disabling method in accordance with the teachings of the present disclosure.
Figure 2:
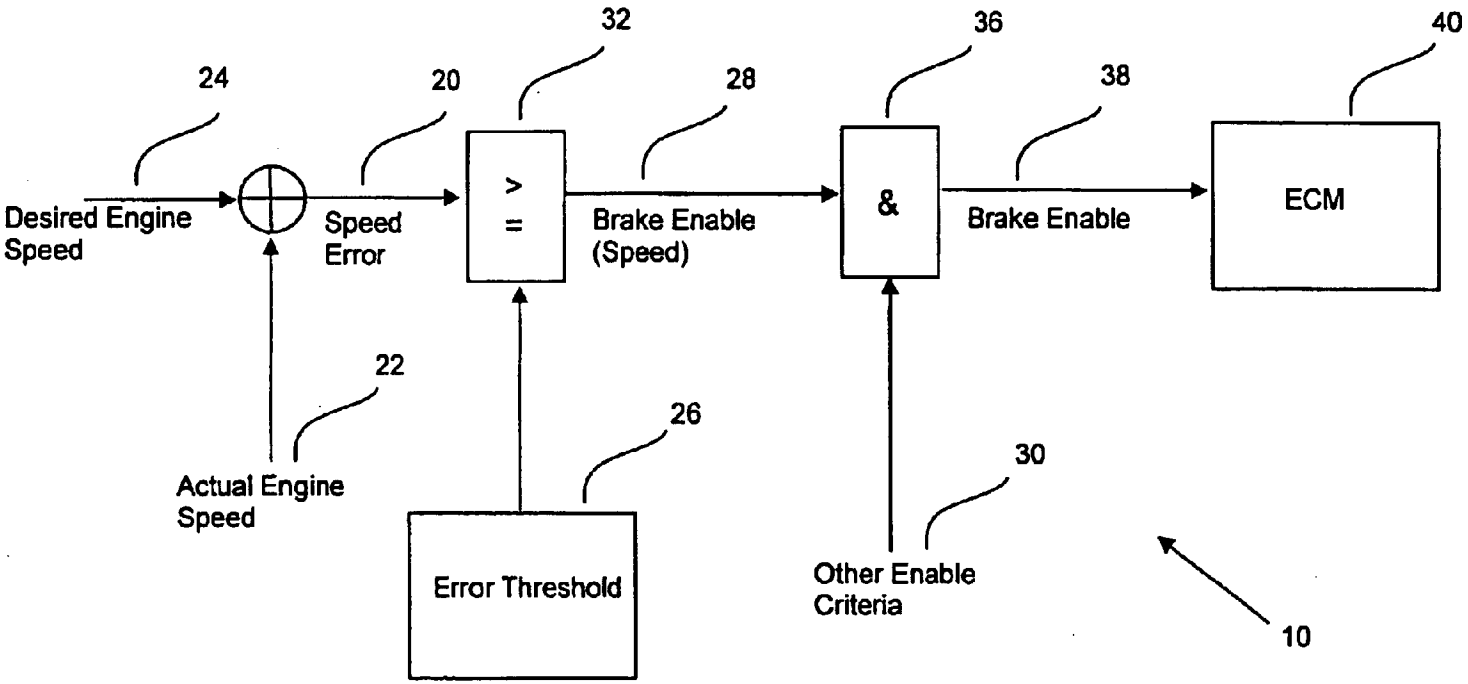
FIG. 2 is a diagram of a second example of a compression release brake disabling method in accordance with the teachings of the present disclosure.

Referring to FIGS. 1 and 2, a compression release brake disabling method 10 in accordance with the present disclosure is generally shown. In a first example of the present disclosure as shown in FIG. 1, the compression release brake disabling method 10 includes determining a speed error 20 from a difference between an actual engine speed 22 and a desired engine speed 24, comparing the speed error 20 to an error threshold 26, and generating a first brake enable command 28 if the speed error 20 is greater than or equal to the error threshold 26. In a second example of the present disclosure as shown in FIG. 2, the method 10 further includes a second brake enable command 30 that is determined from one or more brake enable criteria other than engine speed. Accordingly, the method 10 enables compression release engine braking if both the first brake enable command 28 and the second brake enable command 30 indicate enabling of compression release engine braking. Enabling compression release engine braking does not necessarily activate engine braking, but only allows compression release braking to be activated if desired.

The compression release engine brake disabling method 10 receives the actual engine speed 22 and the desired engine speed 24. The actual engine speed 22 may be in the form of an electrical signal from one or more engine speed sensors that detect the rotational speed of the engine. Such sensors typically detect the rotational speed of the engine's crankshaft or camshaft, which may be represented as engine Revolutions Per Minute (RPM). The desired engine speed 24 indicates the engine speed at which compression release engine braking is disabled in the absence of any error threshold 26. For instance, if the desired engine speed 24 is 1000 RPM, in the absence of the error threshold 26 (or if the error threshold 26 is zero), the compression release braking will disable at engine speeds below 1000 RPM and will enable at engine speeds greater than or equal to 1000 RPM.

The speed error 20 is calculated by subtracting the desired engine speed 24 from the actual engine speed 22. Accordingly, the speed error 20 indicates whether the actual engine speed 22 is above or below the desired engine speed 24. The error threshold 26 indicates the engine speed threshold by which the actual engine speed 22 may be offset from the desired engine speed 24 for compression release engine braking to be disabled. A compare module 32 may be used to compare the speed error 20 to the error threshold 26 to determine whether the speed error 20 is greater than or equal to the error threshold 26. If the speed error 20 is greater than or equal to the error threshold 26, the first brake enable command 28 is generated. In contrast, if the speed error 20 is less than the error threshold 26, no brake enable command 28 is generated. Accordingly, compression release braking is not enabled in the absence of a brake enable command 28.

The error threshold 26 may be set to a predetermined value during a particular operational phase of a machine, may vary based on driver input, or may vary continuously based on various operational conditions of the machine. For example, the error threshold 26 may be set to a value of 200 RPM during a particular operational phase of the machine. Accordingly, if the desired speed is set to 1000 RPM, compression release engine braking will be enabled at engine speeds above or equal to 1200 RPM. The error threshold 26 may continuously vary based on the operational parameters of the machine. For instance, when the machine is operating at high altitude, the error threshold 26 may be set to a higher value so that the engine can recover after compression release engine braking is disabled. Accordingly, the error threshold 26 can vary based on the operational altitude of the machine. The error threshold 26 may also vary based on the number of cylinders that are used during compression release engine braking. For example, if the engine of the machine is using all cylinders for compression release engine braking, the error threshold 26 may be set to a higher value so that the engine can recover after the compression release engine braking is disabled. Thus, the error threshold 26 can be continuously determined based on the number of cylinders that are used during compression release engine braking. In any event, one of ordinary skill in the art will appreciate that the value of the error threshold 26 can be determined based on a number of operational criteria to provide a desired enabling and or disabling of compression release engine braking based on engine speed.

The disclosed method 10 may be software driven and be executed in an Electronic Control Module (ECM) 40 of the engine. Accordingly, as described in the following, the ECM 40 generates software logic commands during the different steps of the disclosed method. The module 32 can generate the brake enable command as a logical ONE or TRUE if engine braking can be enabled, and a logical ZERO or FALSE if engine braking cannot be enabled or should be disabled. The ECM 40 can then enable or disable compression release braking according to the brake enable command 28.

One of ordinary skill in the art will readily appreciate that compression release engine braking is typically activated if other machine operational criteria in addition to engine speed are met (i.e., clutch status, transmission status, etc.). Accordingly, the disclosed method 10 may also determine whether other compression release engine braking criteria in addition to engine speed are met. To that end, an AND module 36 compares the first brake enable command 28 and the second brake enable command 30 to determine whether all compression release engine brake criteria are met. The second brake enable command 30 may be generated by the ECM 40, or other engine control and analysis modules, based on the operational conditions of the machine and/or various engine parameters. If both the first brake enable command 28 and the second brake enable command 30 indicate enablement of engine braking, the AND module 36 generates a final brake enable command 38. Absence of either the first brake enable command 28 or the second brake enable command 30 results in the compression release engine braking either disabling or not enabling.

The AND module 36 may simply include a logical AND operation for determining whether all compression release engine braking criteria are met. For instance, a logical ONE or TRUE signal can indicate that engine braking can be enabled, and a logical ZERO or FALSE can indicate that engine braking should not be enabled or should be disabled. Accordingly, if either the first brake enable command 28 or the second brake enable command 30 is a logical ZERO or FALSE, the logical AND operation of the AND module 36 will result in a logical ZERO or FALSE for the final brake enable command 38. The ECM 40 can then enable or disable compression release braking according to the final brake enable command 38.

INDUSTRIAL APPLICABILITY

A minimum engine speed for enabling compression release engine braking may change based on various factors, such as environmental characteristics, operational conditions of the machine, or the operational status of the engine. The disclosed method continuously or discretely determines a minimum compression release engine brake enabling speed during the operation of a machine based on such factors.

For example, an environmental factor that may affect minimum speed for compression release engine braking is the operational altitude of a machine. Certain machines may experience large enough changes in altitude during a short operational period to cause a shift in the minimum compression release braking speed (i.e., trucks traveling in a mountainous environment). The disclosed method can continuously or at discrete intervals receive an error threshold 26 from the ECM 40 that takes into account the altitude changes experienced by the machine. Accordingly, the minimum speed for enabling compression release braking may be adjusted based on operational altitude of the machine.

In another example, an operational condition of the machine that may affect minimum speed for engine braking is transmission status. If the transmission is in a high gear when compression release engine braking is activated, a predetermined or fixed minimum compression release engine brake enabling speed may be too low and cause the engine to not recover after compression release braking is disabled. In contrast, if the transmission is in a low gear when compression release engine braking is activated, the predetermined or fixed minimum compression release engine brake enabling speed may be too high and cause excessive loads on the engine. The disclosed method can continuously or at discrete intervals receive an error threshold 26 from the ECM 40 that takes into account the current transmission status of the machine. Accordingly, the minimum speed for enabling compression release braking may be adjusted based on the transmission status of the machine.

One of ordinary skill in the art will readily appreciate that the above examples illustrate the versatility of the disclosed method in providing a minimum compression release engine brake enabling speed that takes into account various operational characteristics of a machine. The disclosed method can be implemented in a variety of machines that use compression release engine braking. The disclosed method may be implemented with a software module that communicates with the ECM 40 to control compression release engine braking by using speed error. The ECM 40 may provide the software module the actual engine speed 22, the desired engine speed 24, the error threshold 24, and compression release engine braking enable criteria. The software module may in turn provide the ECM 40 with either the first brake enable command 28 or the final brake enable command 38. The disclosed method may also be an integral part of the software that operates the ECM 40.

The disclosed method 10 also allows an operator of a machine to vary the target speed of the machine by setting the desired engine speed 24 with the throttle. Once the desired engine speed 24 is set by the operator, the compression release braking would then enable or disable to control the speed of the vehicle based on the actual engine speed 22 and the desired engine speed 24.

Although certain methods in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents. Other aspects and features of the present invention can be obtained from a study of the drawings, the disclosure, and the appended claims.

What is claimed is:

1. A method of enabling a compression release engine brake for a machine including an engine, the method comprising:

determining a speed error from an actual engine speed and a desired engine speed;

determining a error threshold based on at least one operational parameter of the machine; and enabling the compression release engine brake if the error threshold is less than the speed error.

2. A method of enabling a compression release engine brake according to claim 1, wherein the speed error is calculated by subtracting the desired engine speed from the actual engine speed.

3. A method of enabling compression release engine brake according to claim 1, wherein the error threshold has a predetermined value.

4. A method of enabling compression release engine braking according to claim 1, including updating the error threshold based on changes in the operational parameter of the machine.

5. A method of controlling compression release engine braking for a machine including an engine, the method comprising:

determining a speed error from an actual engine speed and a desired engine speed;

generating a first brake enable command responsive to an error threshold being less than the speed error;

receiving from an engine electronic control module a second brake enable command responsive to at least one operational parameter of the machine other than engine speed;

enabling compressing release braking responsive to the brake enable command indicating enabling of the compression release braking and the second brake enable command indicating enabling of the compression release braking; and disabling compressing release braking responsive to any one of the first brake enable command or the second brake enable command not indicating enabling of the compression release braking.

6. The method of claim 5, wherein the speed error is calculated by subtracting the desired engine speed from the actual engine speed.

7. The method of claim 5, wherein the error threshold has a predetermined value.

8. The method of claim 5, including determining the error threshold based on at least one operational parameter of the machine, and updating the error threshold based on changes in the operational parameter of the machine.

9. A method for controlling enabling of compression release engine braking for a machine including an engine, the method comprising:

sensing an actual speed of the engine;

determining an engine speed error by subtracting a desired engine speed from the actual engine speed;

determining an error threshold from one or more operational parameters of the machine;

comparing the engine speed error to the error threshold; and generating a brake enable command responsive to the engine speed error being greater than or equal to the error threshold.

10. A method for controlling enabling of compression release engine braking for a machine including an engine, the method comprising:

sensing an actual speed of the engine;

determining an engine speed error by subtracting a desired engine speed from the actual engine speed;

determining an error threshold from one or more operational parameters of the machine;

comparing the engine speed error to the error threshold;

generating a first brake enable command responsive to the engine speed error being greater than or equal to the error threshold;

generating a second brake enable command based on at least one operational parameter of the machine other than the speed of the engine; and generating a final brake enable command responsive to both of the first brake enable command and the second brake enable command indicating enabling of the compression release engine braking.

11. A method of controlling a compression release engine brake for a machine including an engine, the method comprising:

determining a speed error from an actual engine speed and a desired engine speed;

enabling the compression release engine brake if an error threshold is less than the speed error; and disabling the compression release engine brake if the speed error is less than the error threshold.

12. A method of controlling a compression release engine brake according to claim 11, wherein the speed error is calculated by subtracting the desired engine speed from the actual engine speed.

13. A method of controlling a compression release engine brake according to claim 11, wherein the error threshold has a predetermined value.

14. A method of controlling a compression release engine brake according to claim 11, including determining the error threshold based on at least one operational parameter of the machine, and updating the error threshold based on changes in the operational parameter of the machine.

* * * * *

UNITED STATES PATENT AND TRADEMARK OFFICE

CERTIFICATE OF CORRECTION

PATENT NO. : 6,860,253 B1
DATED : March 1, 2005
INVENTOR(S) : Travis E. Barnes et al.

It is certified that error appears in the above-identified patent and that said Letters Patent is hereby corrected as shown below:

Column 5,
Line 11, delete “braking” and insert -- brake --.
Line 26, before “brake” insert -- first --.

Signed and Sealed this

Twenty-fourth Day of May, 2005

JON W. DUDAS
*Director of the United States Patent and Trademark Office*